US009233545B2

(12) United States Patent
Kamo

(10) Patent No.: US 9,233,545 B2
(45) Date of Patent: Jan. 12, 2016

(54) LIQUID EJECTION DEVICE

(71) Applicant: BROTHER KOGYO KABUSHIKI KAISHA, Nagoya-shi, Aichi (JP)

(72) Inventor: Masahiko Kamo, Nagoya (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 0 days.

(21) Appl. No.: 14/497,605

(22) Filed: Sep. 26, 2014

(65) Prior Publication Data

US 2015/0091987 A1 Apr. 2, 2015

(30) Foreign Application Priority Data

Sep. 27, 2013 (JP) ..... 2013-202335

(51) Int. Cl.
*B41J 2/175* (2006.01)

(52) U.S. Cl.
CPC ..... *B41J 2/175* (2013.01)

(58) Field of Classification Search
None
See application file for complete search history.

(56) References Cited

U.S. PATENT DOCUMENTS

| | | | | |
|---|---|---|---|---|
| 6,296,351 | B1 | 10/2001 | Tanaka et al. | |
| 7,128,397 | B2 * | 10/2006 | Silverbrook | 347/49 |
| 2002/0048477 | A1 | 4/2002 | Udagawa et al. | |
| 2005/0088494 | A1 | 4/2005 | Shimizu et al. | |
| 2006/0244797 | A1 | 11/2006 | Tajima | |
| 2009/0189951 | A1 | 7/2009 | Tajima | |
| 2009/0309917 | A1 | 12/2009 | Inada et al. | |
| 2012/0218349 | A1 | 8/2012 | Okazaki et al. | |

FOREIGN PATENT DOCUMENTS

| | | |
|---|---|---|
| JP | 2000-062164 | 2/2000 |
| JP | 4284516 | 6/2009 |
| JP | 2010-018027 | 1/2010 |
| JP | 4666822 | 4/2011 |
| JP | 4963555 | 6/2012 |
| JP | 4985639 | 7/2012 |
| JP | 2012-192727 | 10/2012 |
| JP | 5312209 | 10/2013 |

* cited by examiner

*Primary Examiner* — Justin Seo
(74) *Attorney, Agent, or Firm* — Frommer Lawrence & Haug LLP

(57) ABSTRACT

An ink ejection device includes a head section having a plurality of nozzles and ejecting a plurality of types of inks through the nozzles, and an ink supply section supplying the plurality of types of inks to the head section. The head section has a plurality of supply ports which are arranged in a scanning direction and to which the plurality of types of inks are supplied. The ink supply section includes a plurality of ink chambers which respectively contain the plurality of types of inks and are disposed to overlap one another in the up-down direction, a plurality of connection passages connecting the plurality of supply ports to the plurality of ink chambers containing the inks to be supplied to the supply ports, and a plurality of air discharge passages respectively connected to the plurality of ink chambers.

10 Claims, 11 Drawing Sheets

LIQUID EJECTION DEVICE

CROSS-REFERENCE TO RELATED APPLICATIONS

This non-provisional application claims priority under 35 U.S.C. §119(a) on Patent Application No. 2013-202335 filed in Japan on Sep. 27, 2013, the entire contents of which are hereby incorporated by reference.

TECHNICAL FIELD

The present invention relates to a liquid ejection device.

BACKGROUND

Japanese Patent No. 4985639 discloses, as an example of a liquid ejection device, an inkjet printer. The inkjet printer comprises an inkjet head (liquid ejection head) for ejecting an ink, and a buffer tank (liquid supply tank) disposed above the inkjet head and supplying the ink to the inkjet head.

The inkjet head includes four ink inlet ports to which inks of four colors (of black, magenta, yellow and cyan) are supplied. Here, one ink inlet port is provided for each of the black ink and the magenta ink while two ink inlet ports are provided for each of the yellow ink and the cyan ink. In other words, the inkjet head includes six ink inlet ports in total. The six ink inlet ports are arranged along a scanning direction of the inkjet head.

The buffer tank is connected to four ink tanks through tubes, and the inks of the four colors are respectively supplied from the four ink tanks to the buffer tank. The buffer tank includes six liquid chambers respectively corresponding to the six ink inlet ports of the inkjet head. Here, two liquid chambers are provided for each of the yellow ink and the cyan ink similarly to the ink inlet ports, and the two liquid chambers to which the ink of the same color is introduced are communicated with each other. Besides, the six liquid chambers are arranged along the scanning direction of the inkjet head correspondingly to the six ink inlet ports. The ink supplied from the ink tank to the buffer tank flows into the liquid chamber. Here, if air is mixed with the supplied ink, while the ink is flowing from the liquid chamber to the ink inlet port of the inkjet head disposed below, the air mixed with the ink is separated from the ink to stay in an upper portion of the liquid chamber. Accordingly, the ink contained in the buffer tank is supplied to the inkjet head after the air is separated and removed in the liquid chamber.

SUMMARY

In the inkjet printer disclosed in Japanese Patent No. 4985639, the six liquid chambers are arranged along the scanning direction. Here, as the ink is consumed in the inkjet head, the amount of the air (air bubbles) having been separated from the ink increases in the upper portion of the liquid chamber.

A liquid ejection device according to a first aspect is characterized by a liquid ejection device. The liquid ejection device includes a liquid ejection head including a plurality of nozzles on a surface thereof and configured to eject a plurality of types of liquids, each of the nozzles being configured to eject one type of liquid among the plurality of types of liquids; and a liquid supply tank configured to supply the plurality of types of liquids to the liquid ejection head, wherein the liquid supply tank includes: a plurality of liquid chambers, each of which being configured to contain each type of liquid; and a plurality of connection passages connecting the plurality of supply ports of the liquid ejection head to the plurality of liquid chambers respectively configured to contain the plurality of types of liquids to be supplied to the plurality of supply ports, and the liquid ejection head includes a plurality of supply ports which are arranged along a first direction and to each of which one type of liquid among the plurality of types of liquids is supplied, the plurality of supply ports including a first supply port to which a first liquid among the plurality of types of liquids is supplied and two second supply ports to which a second liquid among the plurality of types of liquids is supplied, and the two second supply ports are disposed on both sides of the first supply port along the first direction, and the second liquid chamber overlaps the first liquid chamber in a direction perpendicular to the surface and crossing the first direction, and is disposed farther away from the liquid ejection head than the first liquid chamber in the direction perpendicular to the surface.

According to the first aspect, the plurality of types of liquids introduced into the liquid supply tank flow into the liquid chambers respectively corresponding to the plurality of types of liquids. The liquids having flown into the liquid chambers are supplied via the connection passages to the supply ports of the liquid ejection head. When the liquids flow from the liquid chambers to the connection passages, a gas mixed with the liquids is separated from the liquids, and is left and stays in an upper portion of each liquid chamber.

Besides, while the plurality of supply ports of the liquid ejection head are arranged along the first direction, the plurality of liquid chambers connected to the plurality of supply ports are arranged along the direction perpendicular to the surface. Therefore, a space on the side of the first liquid chamber opposite to the liquid ejection head can be effectively utilized.

In the first aspect, the plurality of supply ports of the liquid ejection head are arranged along the first direction. Besides, the plurality of liquid chambers of the liquid supply tank connected to the plurality of supply ports are arranged along the direction perpendicular to the surface, said direction crossing the first direction. Therefore, a space on the side of the first liquid chamber opposite to the liquid ejection head can be effectively utilized.

The above and further objects and features will more fully be apparent from the following detailed description with accompanying drawings.

DETAILED DESCRIPTION

Figure 1:
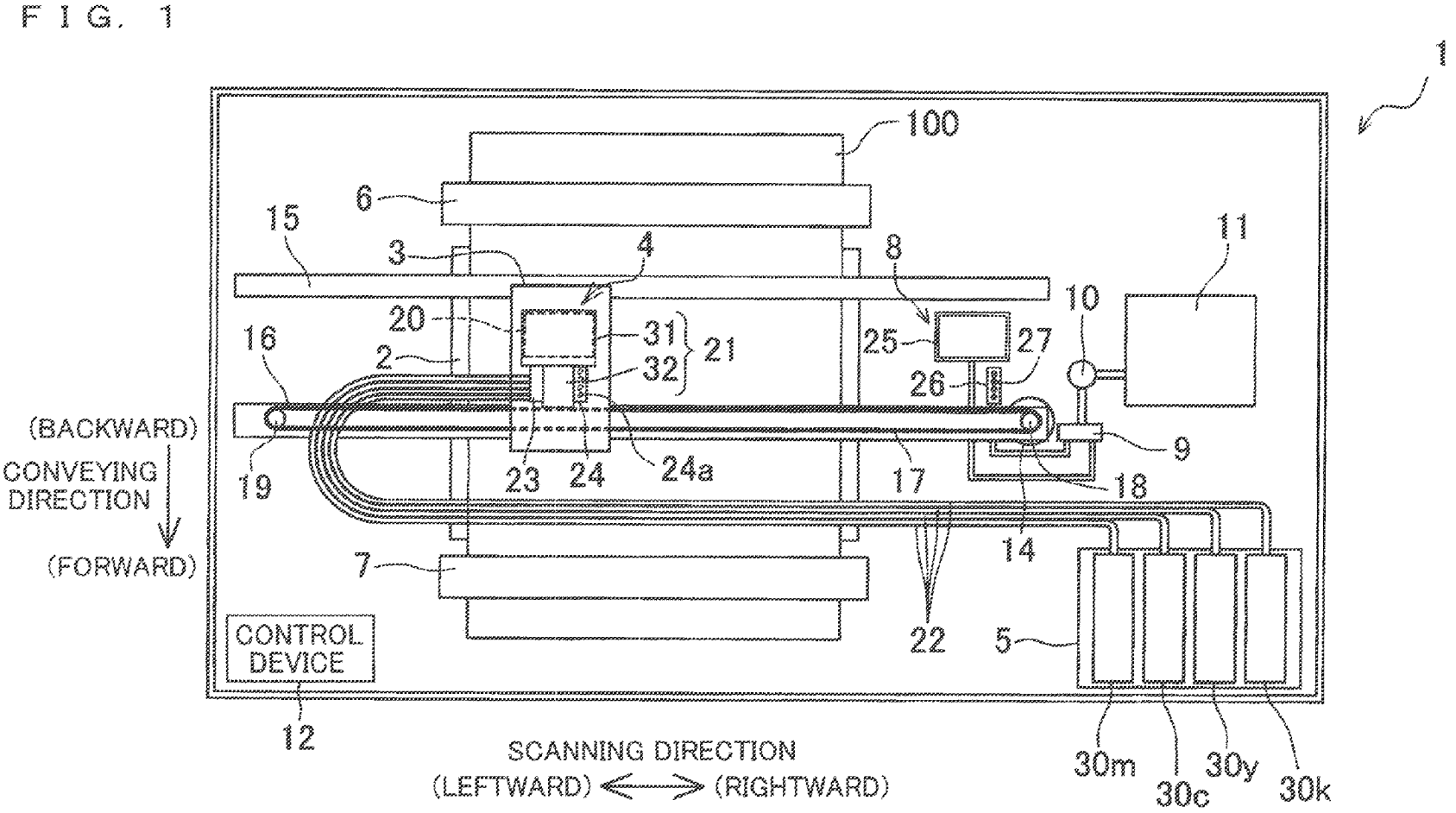
FIG. 1 is a schematic plan view of a printer according to the present embodiment.

The present embodiment will now be described. FIG. 1 is a schematic plan view of a printer according to the present embodiment.

(Schematic Structure of Printer)

As illustrated in FIG. 1, the printer 1 comprises a platen 2, a carriage 3, an ink ejection device 4, a holder 5, a paper feeding roller 6, a paper discharging roller 7, a cap device 8, a switching device 9, a suction pump 10, a waste liquid tank 11, a control device 12 and the like. In the following description, the near side with respect to the paper of FIG. 1 is referred to as the "upward" of the printer 1 and the far side with respect to the paper is referred to as the "downward" of the printer 1. Furthermore, the "forward" or "backward" direction and the "leftward" or "rightward" direction illustrated in FIG. 1 are respectively defined as a "front-back direction" and a "left-right direction" of the printer 1. The following description will be given by appropriately using terms relating to the directions such as front/back, right/left and up/down.

Recording paper 100 corresponding to a recording medium is placed on the top surface of the platen 2. Besides, two guide rails 15 and 16 extending in parallel with the left-right direction of FIG. 1 (also designated as a scanning direction) are provided above the platen 2.

The carriage 3 is attached to the two guide rails 15 and 16 so as to be movable in the scanning direction along the two guide rails 15 and 16 in a region opposing the platen 2. Besides, to the carriage 3 a driving belt 17 is attached. The driving belt 17 is an endless belt wound around two pulleys 18 and 19. Here, the driving belt 17 is attached to a front end portion of the carriage 3 in a forward position with respect to the ink ejection device 4 described later. The pulley 18 is connected to a carriage drive motor 14. The carriage drive motor 14 rotationally drives the pulley 18 so as to run the driving belt 17, and thus, the carriage 3 is reciprocated in the scanning direction.

The ink ejection device 4 (corresponding to an example of a liquid ejection device) is mounted on the carriage 3. The ink ejection device 4 includes a head section 20 (corresponding to an example of a liquid ejection head) and an ink supply section 21 (corresponding to an example of a liquid supply tank). Besides, four ink cartridges 30 respectively containing inks of four colors (of black, yellow, cyan and magenta) (corresponding to an example of a liquid storage tank) are removably attached to the holder 5. In the following description, constitutional elements of the printer 1 respectively corresponding to the black (K), yellow (Y), cyan (C) and magenta (M) inks are appropriately referred to by using any of signs of "k" for black, "y" for yellow, "c" for cyan and "m" for magenta added to reference signs of the constitutional elements. For example, an ink cartridge 30*k* refers to an ink cartridge 30 containing the black ink. Besides, the inks of the three colors of yellow, cyan and magenta excluding the black ink are sometimes generically designated as the "color ink".

The head section 20 has a plurality of nozzles 47 (see FIGS. 3 and 4) on its lower surface 46*a*, and the ink is ejected through the nozzles 47. A specific structure and the like of passages in the head section 20 will be described in detail later.

The ink supply section 21 is disposed above the head section 20 and supplies the inks of the four colors to the head section 20. The ink supply section 21 includes a first ink supply member 31 and a second ink supply member 32. To the ink supply section 21, four tubes 22 connected to the holder 5 are connected via a tube joint 23. Here, the cyan ink and the magenta ink are supplied to the first ink supply member 31 and the black ink and the yellow ink are supplied to the second ink supply member 32, which will be described in detail later. Besides, an air discharge section 24 is provided in the ink supply section 21. The air discharge section 24 discharges air present in the two ink supply members 31 and 32 before the air moves to the head section 20. Four ink supply passages 60 (see FIG. 5) formed in the two ink supply members 31 and 32 are respectively connected to four air discharge ports 24*a* of the air discharge section 24 via four air discharge passages 65. Here, each of the air discharge ports 24*a* is provided with a valve (not shown) for switching connection/disconnection to/from the outside.

The paper feeding roller 6 and the paper discharging roller 7 are rotationally driven in synchronization with each other by a motor not shown. The paper feeding roller 7 and the paper discharging roller 7 cooperate together to convey the recording paper 100 placed on the platen 2 in a conveying direction (forward) of FIG. 1.

Then, the printer 1 prints a desired image or the like on the recording paper 100 by ejecting the inks through the plural nozzles 47 of the head section 20 in the up-down direction while conveying the recording paper 100 in the conveying direction by the paper feeding roller 6 and the paper discharging roller 7 and while moving the ink ejection device 4 together with the carriage 3 in the scanning direction.

The cap device 8 is disposed on one side (a right-hand side) of the platen 2 along the scanning direction. The cap device 8 includes a nozzle cap 25 and an air discharge cap 26. Besides, the cap device 8 is driven by a cap raising/lowering mechanism not shown to be raised and lowered in the up-down direction (the direction vertical to the paper of FIG. 1).

When the carriage 3 is moved to the right-hand side of the platen 2, the nozzle cap 25 opposes the lower surface of the head section 20, and the air discharge cap 26 opposes the four air discharge ports 24*a* of the air discharge section 24. When the cap device 8 is raised under this condition, the cap device 8 is attached to the ink ejection device 4. At this point, the plural nozzles 47 of the head section 20 are covered by the nozzle cap 25, and the air discharge cap 26 is connected to the four air discharge ports 24*a* of the air discharge section 24. The air discharge cap 26 is provided with four rod-shaped opening/closing members 27 for respectively opening/closing the valves provided in the four air discharge ports 24*a*. Although not described in detail herein, with the air discharge cap 26 connected to the four air discharge ports 24*a*, the four rod-shaped opening/closing members 27 are driven in the up-down direction by a drive mechanism not shown to be inserted from below into the air discharge ports 24*a*, thereby driving the valves provided therein.

The nozzle cap 25 and the air discharge cap 26 are connected to the suction pump 10 via the switching device 9. The connection of the suction pump 10 is switched by the switching device 9 to the nozzle cap 25 or the air discharge cap 26, so that suction purge and air discharge purge described below can be selectively executed.

(Suction Purge)

With the plural nozzles 47 of the head section 20 covered by the nozzle cap 25, the internal pressure of the nozzle cap 25 is reduced by the suction pump 10, thereby sucking and discharging the ink out of the plural nozzles 47. In this manner, contamination, air bubbles, or the ink having a viscosity increased through drying are discharged out of the head section 20.

(Air Discharge Purge)

With the air discharge cap 26 connected to the air discharge ports 24*a* and with the valves provided in the air discharge ports 24*a* opened by the opening/closing members 27, a negative pressure is applied to the air discharge ports 24*a* by the suction pump 10. In this manner, the air present in the ink supply section 21 is discharged from the air discharge ports 24*a* before moving to the head section 20.

Here, the ink discharged from the head section 20 or the ink supply section 21 of the ink ejection device 4 in the suction purge or the air discharge purge is sent to the waste liquid tank 11 connected to the suction pump 10.

The control device 12 controls the respective components of the printer 1 described above for executing various operations such as a printing operation on the recording paper 100. For example, the control device 12 controls the ink ejection device 4, the carriage drive motor 14 and the like on the basis of a print instruction sent from an external device such as a personal computer, so as to print an image or the like on the recording paper 100. Moreover, the control device 12 controls the switching device 9, the suction pump 10 and the like, so as to execute the aforementioned suction purge or air discharge purge.

(Details of Ink Ejection Device)

Figure 2:
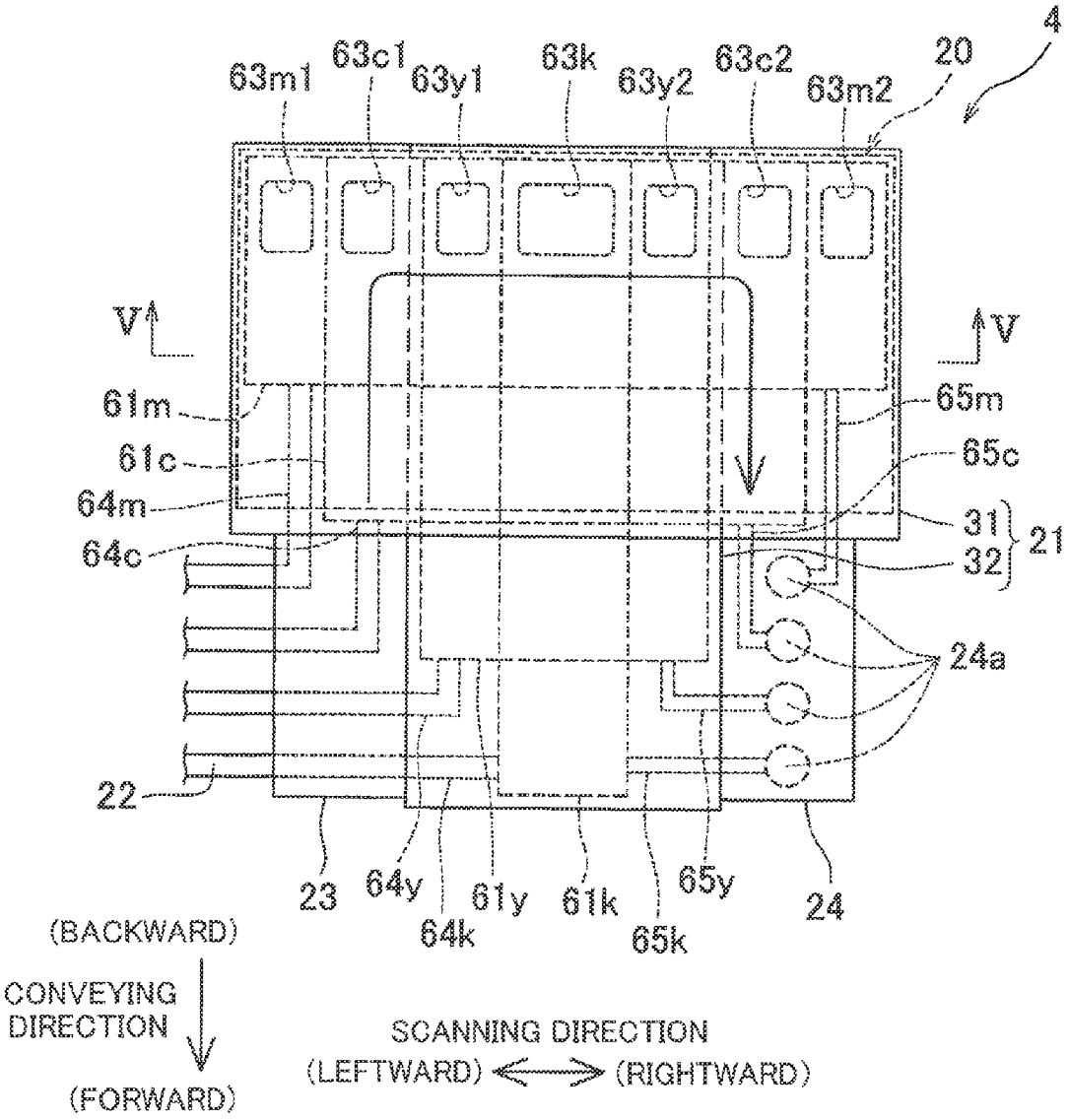
FIG. 2 is a top view of an ink ejection device.

Next, the detailed structure of the ink ejection device 4 will be described. FIG. 2 is a top view of the ink ejection device 4. As described above, the ink ejection device 4 includes the head section 20 and the ink supply section 21 disposed above the head section 20.

(Structure of Head Section)

Figure 3:
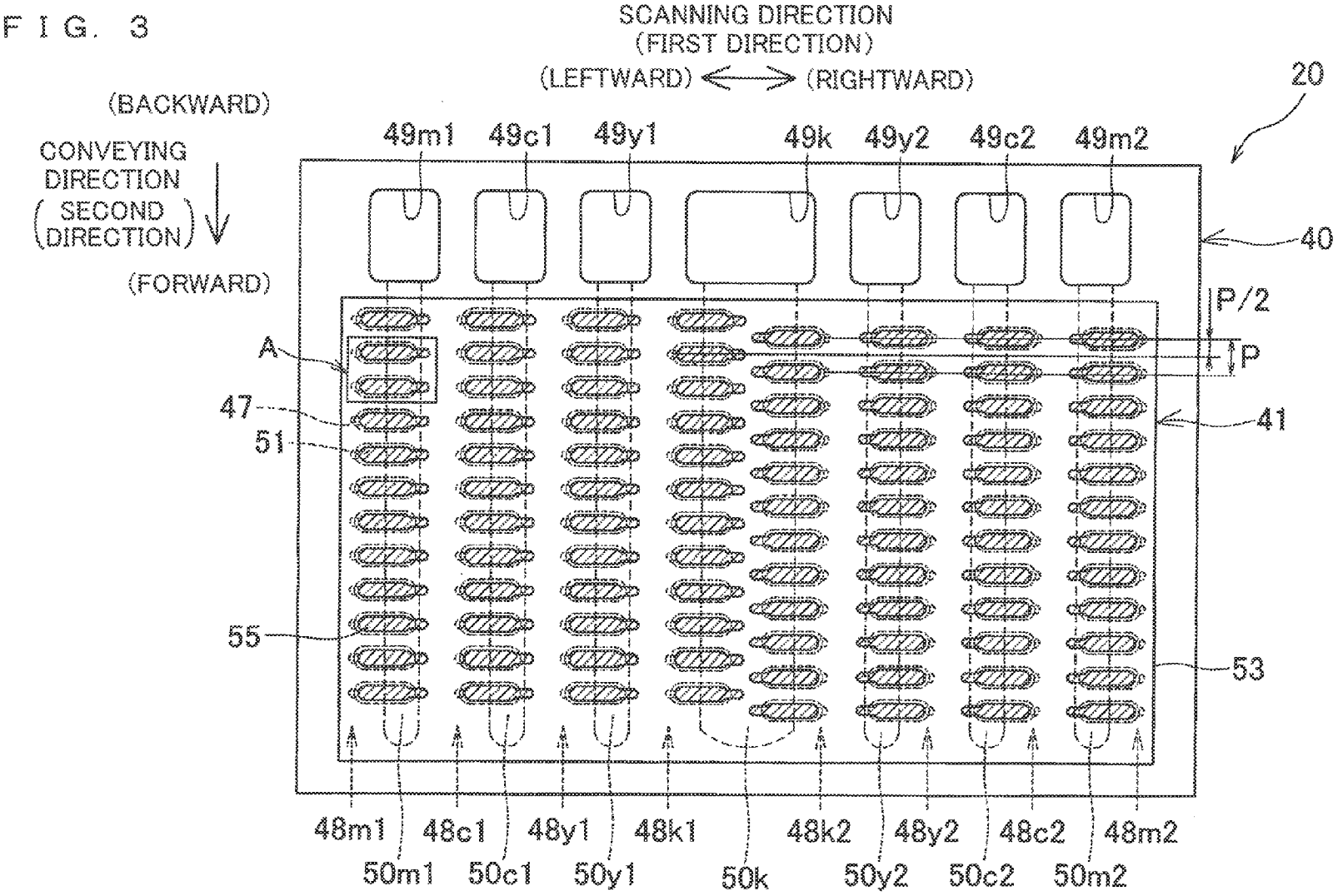
FIG. 3 is a top view of a head section.
Figure 4A:
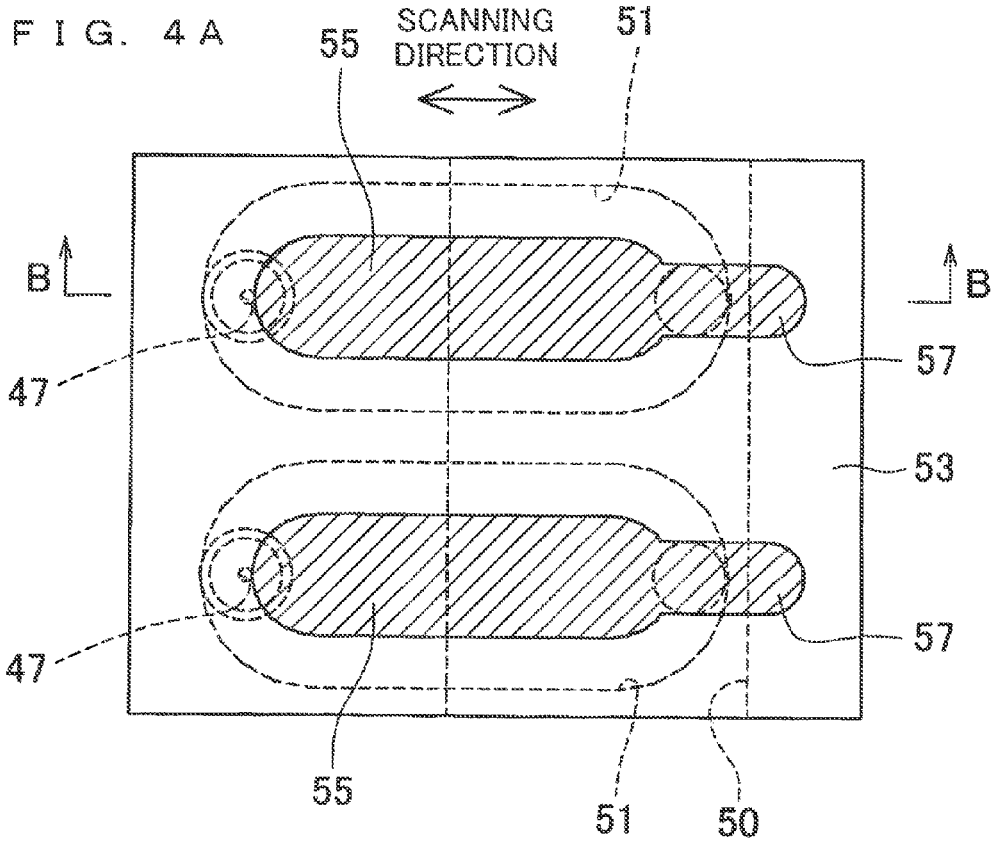
FIG. 4A is an enlarged view of a part A of FIG. 3.
Figure 4B:
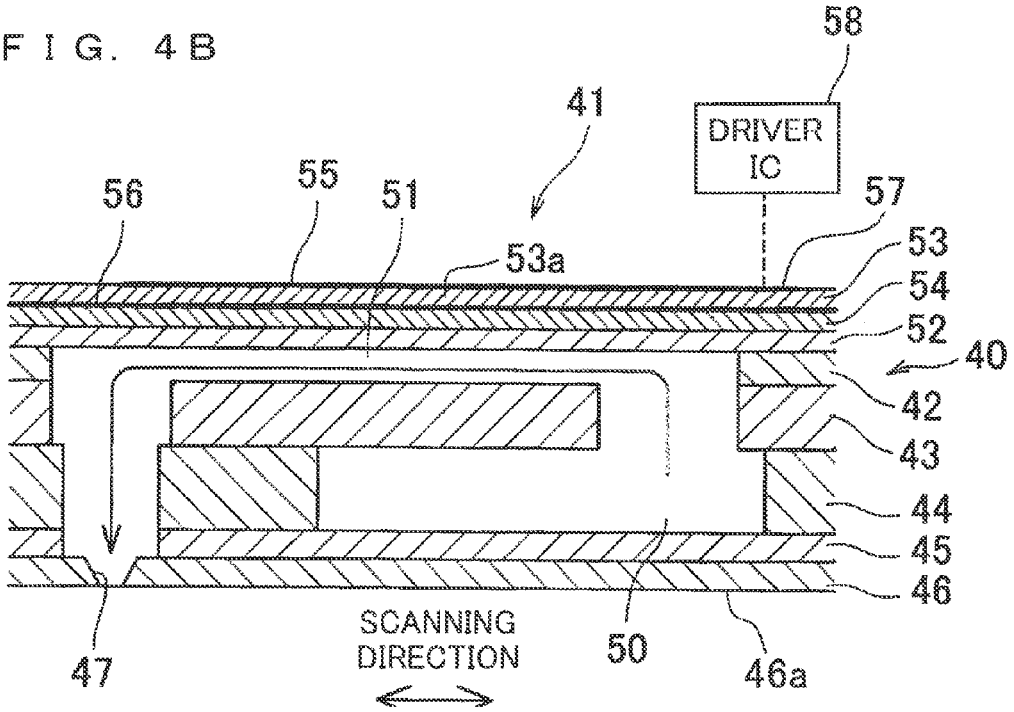
FIG. 4B is a cross-sectional view taken on line B-B of FIG. 4A.

First, the structure of the head section 20 will be described. FIG. 3 is a top view of the head section 20. FIG. 4A is an enlarged view of a part A of FIG. 3, and FIG. 4B is a cross-sectional view taken on line B-B of FIG. 4A. As illustrated in FIGS. 3, 4A and 4B, the head section 20 includes a passage unit 40 and a piezoelectric actuator 41.

(Passage Unit)

As illustrated in FIG. 4B, the passage unit 40 has a structure in which five plates 42 to 46 are stacked on one another. The lowermost plate 46 among the five plates 42 to 46 corresponds to a nozzle plate in which the plural nozzles 47 are formed. On the other hand, in the other upper four plates 42 to 45, passages including manifolds 50, pressure chambers 51 and the like communicated with the plural nozzles 47 are formed.

Referring to FIG. 3 in particular, the arrangement of the plural nozzles 47 formed in the nozzle plate 46 will be described. In the nozzle plate 46, the plural nozzles 47 are arranged along the conveying direction (corresponding to an example of a second direction) at a pitch P, and the plural nozzles 47 form eight nozzle groups 48 in total arranged in the scanning direction (corresponding to an example of a first direction). Here, although the arranging direction (i.e., the second direction) of the plural nozzles 47 is perpendicular to the scanning direction (i.e., the first direction) in the present embodiment, which is not indispensable, but the arranging direction of the nozzles 47 may cross the scanning direction at any angle other than 90 degrees.

The eight nozzle groups 48 include two nozzle groups 48*k*1 and 48*k*2 for ejecting the black ink, two nozzle groups 48*y*1 and 48*y*2 for ejecting the yellow ink, two nozzle groups 48*c*1 and 48*c*2 for ejecting the cyan ink, and two nozzle groups 48*m*1 and 48*m*2 for ejecting the magenta ink. Here, between the two nozzle groups 48 for ejecting the ink of the same color (for example, between the two nozzle groups 48*k*1 and 48*k*2), the positions of the nozzles 47 along the arranging direction thereof are shifted by a half of the pitch P employed in each nozzle group 48 (i.e., by P/2).

The two nozzle groups 48*k*1 and 48*k*2 for the black ink are disposed to be adjacent to each other in a center portion along the scanning direction. The two nozzle groups 48*y*1 and 48*y*2 for the yellow ink are disposed on both sides of the two nozzle groups 48*k*1 and 48*k*2 for the black ink along the scanning direction in a manner that the two nozzle groups 48*k*1 and 48*k*2 are located therebetween. The two nozzle groups 48*c*1 and 48*c*2 for the cyan ink are disposed on both sides of the four nozzle groups 48*k*1, 48*k*2, 48*y*1 and 48*y*2 in a manner that the four nozzle groups 48*k*1, 48*k*2, 48*y*1 and 48*y*2 are located therebetween, and the two nozzle groups 48*m*1 and 48*m*2 for the magenta ink are disposed on both sides of the six nozzle groups 48*k*1, 48*k*2, 48*y*1, 48*y*2, 48*c*1 and 48*c*2 in a manner that the six nozzle groups 48*k*1, 48*k*2, 48*y*1, 48*y*2, 48*c*1 and 48*c*2 are located therebetween. In other words, the nozzle groups 48 for the inks of the four colors of black, yellow, cyan and magenta are arranged in bilateral symmetry.

Accordingly, in what is called the bidirectional printing, the four nozzle groups 48 disposed on each of the right and left sides are appropriately used depending on whether the carriage 3 is moved to one side or the other side along the scanning direction. Therefore, the inks of the four colors are jetted onto the recording paper 100 always in the same order (namely, in the order of magenta, cyan, yellow and black) to form each dot, regardless of the direction the carriage 3 is moved. In other words, since the nozzles are arranged in the aforementioned manner, while employing the bidirectional printing having a merit of a high recording speed, a high quality image or the like can be recorded by making uniform the shade of color in respective dots.

The arrangement of the nozzle groups 48*m*, 48*c* and 48*y* for the three color inks disposed on the right and left sides of the nozzle group 48*k* for the black ink is not limited to the bilateral symmetrical arrangement illustrated in FIG. 3 but can be appropriately modified. For example, on the both left and right sides of the nozzle group 48*k* for the black ink, the nozzle groups 48*m*, 48*c* and 48*y* for the three color inks may be arranged in the order of magenta, cyan and yellow from the left-hand side.

Furthermore, although the nozzles 47 of all the nozzle groups 48 have the same nozzle diameter in the printer 1 having the aforementioned structure, nozzles having two types of nozzle diameters may be provided for each of the color inks of yellow, cyan and magenta for performing multi-gradation printing.

Next, the structure of passages communicated with the plural nozzles 47 and formed in the upper four plates 42 to 45 of the passage unit 40 will be described. First, as illustrated in FIG. 3, seven supply ports 49 arranged along the scanning direction are formed on the top surface of the upstream end portion of the passage unit 40 along the conveying direction. To the supply ports 49, the inks of the four colors are supplied from the ink supply section 21 described later. The seven supply ports 49 include a supply port 49*k* for the black ink (corresponding to an example of a first supply port), two supply ports 49*y*1 and 49*y*2 for the yellow ink (corresponding to an example of a second supply port), two supply ports 49*c*1 and 49*c*2 for the cyan ink (corresponding to an example of the second supply port), and two supply ports 49*m*1 and 49*m*2 for the magenta ink (corresponding to an example of the second supply port). Here, although the seven supply ports 49 of the head section 20 are linearly arranged on one plane in FIG. 3, the arrangement of the supply ports is not limited to this. For example, the positions of the seven supply ports 49 may be slightly different from one another in the up-down direction. Alternatively, the seven supply ports 49 may be arranged along a direction slightly inclined against the horizontal direction (i.e., the scanning direction or the first direction).

The seven supply ports 49 are arranged along the scanning direction in the order corresponding to the aforementioned arrangement of the nozzle groups 48 for the inks of the four colors. Specifically, the supply port 49*k* for the black ink is first disposed in a center portion along the scanning direction. On the outside (on each of the right and left sides) of the supply port 49*k* for the black ink along the scanning direction, the supply port 49*y* for the yellow ink, the supply port 49*c* for the cyan ink and the supply port 49*m* for the magenta ink are arranged in this order to be in bilateral symmetry. In other words, the two supply ports 49*y* for the yellow ink are disposed in a manner that the supply port 49*k* for the black ink is located therebetween in the scanning direction, the two supply ports 49*c* for the cyan ink are disposed in a manner that the three supply ports 49*k* and 49*y* are located therebetween in the scanning direction, and the two supply ports 49*m* for the magenta ink are disposed in a manner that the five supply ports 49*k*, 49*y*, and 49*c* are located therebetween in the scanning direction. It is noted that the supply port 49*k* for the black ink has a hole with a larger size than those of the other six supply ports 49 because the black ink is supplied therethrough to the two nozzle groups 48*k*1 and 48*k*2.

Furthermore, seven manifolds 50 extending in the conveying direction are formed inside the passage unit 40. The rear ends of the seven manifolds 50 are respectively connected to the seven supply ports 49. The black ink is supplied to a manifold 50*k* through the supply port 49*k*. The yellow ink is supplied to manifolds 50*y*1 and 50*y*2 through the supply ports 49*y*1 and 49*y*2. The cyan ink is supplied to manifolds 50*c*1 and 50*c*2 through the supply ports 49*c*1 and 49*c*2. The magenta ink is supplied to manifolds 50*m*1 and 50*m*2 through the supply ports 49*m*1 and 49*m*2. Here, with respect to the passage for the black ink, two supply ports 49*k* and two manifolds 50*k* may be provided in the same manner as in the passages for the other color inks.

The manifolds 50 for the inks of the four colors of black, yellow, cyan and magenta are provided in bilateral symmetry in the same manner as the nozzle groups 48 for the inks of the four colors described above. Specifically, the manifold 50*k* for the black ink is disposed in a center portion along the scanning direction. The two manifolds 50*y*1 and 50*y*2 for the yellow ink are disposed on both sides of the manifold 50*k* in a manner that the manifold 50*k* is located therebetween. The two manifolds 50*c*1 and 50*c*2 for the cyan ink are disposed on both sides of the manifolds 50*k* and 50*y* in a manner that the manifolds 50*k* and 50*y* are located therebetween, and the two manifolds 50*m*1 and 50*m*2 for the magenta ink are disposed on both sides of the manifolds 50*k*, 50*y* and 50*c* in a manner that the manifolds 50*k*, 50*y* and 50*c* are located therebetween.

Besides, the passage unit 40 has a plurality of pressure chambers 51 respectively corresponding to the plural nozzles 47. The plural pressure chambers 51 are formed in the plate 42 provided as the uppermost layer in the passage unit 40, and are respectively disposed correspondingly to the plural nozzles 47. As illustrated in FIG. 3, the pressure chambers 51 are arranged above the manifolds 50 in eight lines along the conveying direction correspondingly to the eight nozzle groups 48. Here, since the two nozzle groups 48*k*1 and 48*k*2 for the black ink are disposed adjacent to each other in the scanning direction and the two lines of the pressure chambers corresponding to the two nozzle groups are adjacent to each other, the two lines of the pressure chambers for the black ink are both communicated with the same manifold 50*k* disposed directly therebelow. On the other hand, each line of pressure chambers corresponding to each of the other nozzle groups 48 is communicated with one manifold 50 positioned directly therebelow. Accordingly, as illustrated with an arrow in FIG. 4B, a plurality of individual passages each branched from each manifold 50, passing through the corresponding pressure chamber 51 and reaching the corresponding nozzle 47 are formed in the passage unit 40.

(Piezoelectric Actuator)

The piezoelectric actuator 41 is connected onto the top surface of the passage unit 40 so as to cover the plural pressure chambers 51. As illustrated in FIGS. 3, 4A and 4B, the piezoelectric actuator 41 includes an ink sealing film 52, two piezoelectric layers 53 and 54, a plurality of individual electrodes 55 and a common electrode 56.

The ink sealing film 52 is a thin film made of a material with a low ink permeability, such as a metal material of stainless steel or the like. The ink sealing film 52 is connected onto the top surface of the passage unit 40 so as to cover the plural pressure chambers 51.

Each of the two piezoelectric layers 53 and 54 is made of a piezoelectric material containing, as a principal component, lead titanate zirconate, that is, mixed crystal of lead titanate and lead zirconate. The piezoelectric layers 53 and 54 stacked on each other are disposed on the top surface of the ink sealing film 52.

The plural individual electrodes 55 are disposed on the top surface of the upper piezoelectric layer 53. More specifically, as illustrated in FIGS. 3, 4A and 4B, each of the individual electrodes 55 is disposed on the top surface of the piezoelectric layer 53 in a region corresponding to the center of each pressure chamber 51. The plural individual electrodes 55 are arranged respectively correspondingly to the plural pressure chambers 51, and form eight lines in total of the individual electrodes. An individual terminal 57 is drawn out from each of the individual electrodes 55. To the individual terminals 57, a wiring member not shown having a driver IC 58 mounted thereon is connected. Thus, the plurality of individual electrodes 55 are electrically connected to the driver IC 58. The driver IC 58 selectively applies, to each of the individual electrodes 55, either a predetermined driving potential or a ground potential.

The common electrode 56 is disposed between the two piezoelectric layers 53 and 54. The common electrode 56 opposes the plural individual electrodes 55 with the piezoelectric layer 53 therebetween. Although a specific electrical connection structure is not herein illustrated, a connection terminal is also drawn out from the common electrode 56 onto the top surface of the piezoelectric layer 53, so as to be connected to the wiring member not shown in the same manner as the plural individual electrodes 55. The common electrode 56 is connected to a ground wire formed in the wiring member, and hence, the potential of the common electrode 56 is always retained at the ground potential.

Here, a portion of the piezoelectric layer 53 disposed between each individual electrode 55 and the common electrode 56 (which portion is herein designated as an active portion 53*a*) is polarized in the thickness direction (downward). The active portion 53*a* corresponds to a portion where piezoelectric deformation (piezoelectric strain) occurs when a potential difference is caused between the individual electrode 55 and the common electrode 56 to form an electric field in the thickness direction.

The operation of the piezoelectric actuator 41 will now be described. When a driving potential is applied by the driver IC 58 to a given individual electrode 55, a potential difference is caused between this individual electrode 55 and the common electrode 56. At this point, an electric field is formed in the thickness direction (downward) in the active portion 53*a* of the piezoelectric layer 53, and the direction of the electric field accords with the polarization direction of the active portion 53*a*. Therefore, the active portion 53*a* shrinks in the surface direction, and in accordance with the shrinkage of the active portion 53*a*, a deformation so as to be convex toward the pressure chamber 51 is caused in the two piezoelectric layers 53 and 54. As a result, the volume of the pressure chamber 51 is changed to cause a pressure wave in the individual passage including this pressure chamber 51, so that ejection energy can be applied to the ink for ejecting droplets of the ink through the nozzle 47.

(Structure of Ink Supply Section)

Figure 5:
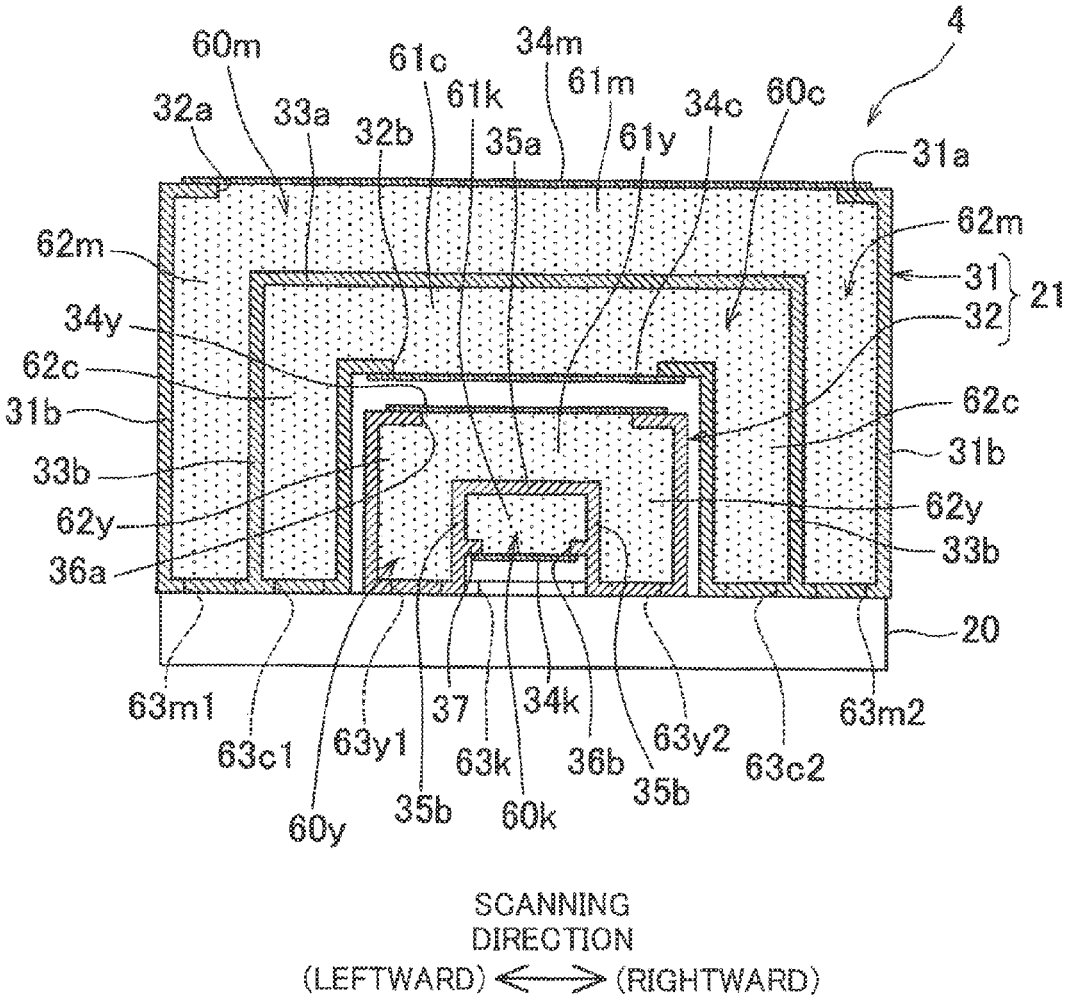
FIG. 5 is a cross-sectional view taken on line V-V of FIG. 2.
Figure 6A:
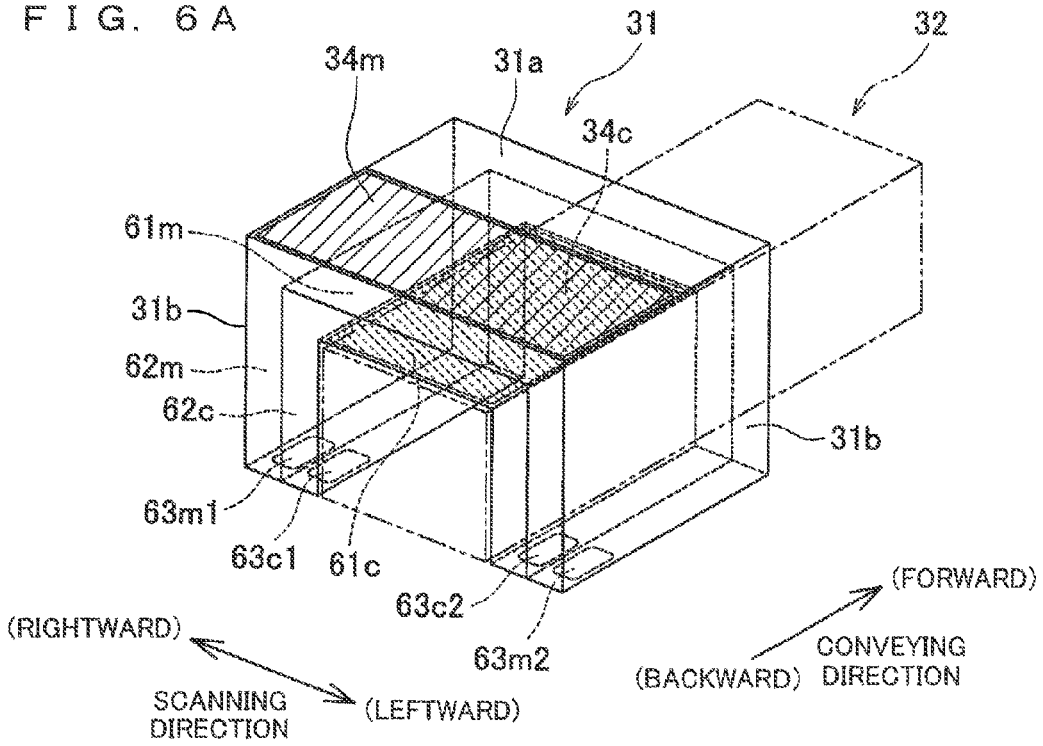
FIG. 6A is a perspective view of an ink supply member.
Figure 6B:
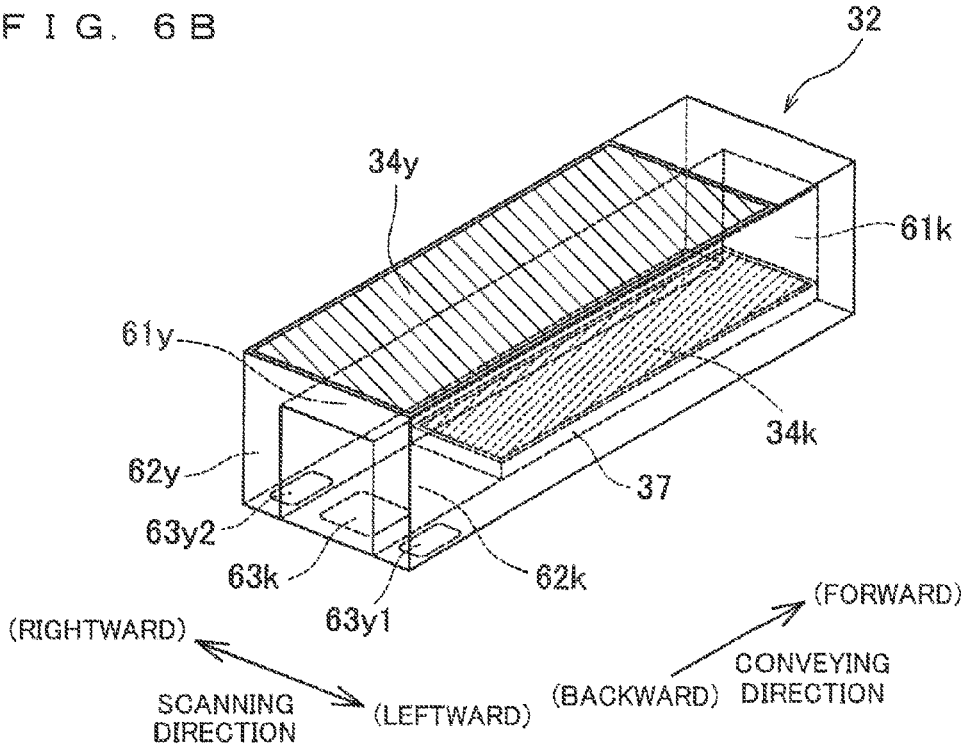
FIG. 6B is a perspective view of another ink supply member.

Next, the ink supply section 21 will be described. The ink supply section 21 includes four ink chambers 61 (an example of a liquid chamber) for respectively containing the inks of the four colors, and after separating air mixed with the ink in each of the ink chambers 61, the ink supply section supplies the resultant inks of the four colors to the head section 20. As illustrated in FIG. 2, the ink supply section 21 includes the first ink supply member 31 and the second ink supply member 32. FIG. 5 is a cross-sectional view taken on line V-V of FIG. 2. FIGS. 6A and 6B are perspective views of the first and second ink supply member 31 and 32, respectively.

As illustrated in FIGS. 5, 6A and 6B, the first ink supply member 31 is a member having a U-shaped cross-section. The second ink supply member 32 is a substantially rectangular parallelopiped member shorter in the scanning direction and longer in the conveying direction than the first ink supply member 31. The second ink supply member 32 is disposed inside the first ink supply member 31 having the U-shaped cross-section with a small gap kept therebetween. Besides, as illustrated in FIGS. 2 and 6A, the rear end surface of the second ink supply member 32 is disposed in substantially the same position as the rear end surface of the first ink supply member 31 while the front end surface of the second ink supply member 32 protrudes forward beyond the first ink supply member 31. As illustrated in FIG. 5, the first ink supply member 31 and the second ink supply member 32 are disposed with their lower surfaces in contact with the top surface of the head section 20.

First, the first ink supply member 31 will be described. As illustrated in FIGS. 5 and 6A, the first ink supply member 31 includes a horizontal portion 31*a* having a rectangular shape in a plan view extending on the horizontal plane, and two leg portions 31*b* extending downward from the both ends of the horizontal portion 31*a* along the scanning direction. The inside of the first ink supply member 31 is divided into two inner and outer spaces by partition walls 33*a* and 33*b*. The outer space corresponds to an ink supply passage 60*m* where the magenta ink passes, and the inner space corresponds to an ink supply passage 60*c* where the cyan ink passes.

More specifically, the space inside the horizontal portion 31*a* of the first ink supply member 31 is divided up and down by the horizontal partition wall 33*a*, so as to form an upper (outer) ink chamber 61*m* where the magenta ink is contained and a lower (inner) ink chamber 61*c* where the cyan ink is contained. Besides, the spaces inside the two leg portions 31*b* are respectively divided by the two partition walls 33*b* extending in the up-down direction, so as to form two outer connection passages 62*m* for the magenta ink and two inner connection passages 62*c* for the cyan ink. The two connection passages 62*m* for the magenta ink are communicated with the ink chamber 61*m* at the both ends of the ink chamber 61*m* for the magenta ink along the scanning direction, and extend in the up-down direction. The two connection passages 62*c* for the cyan ink are communicated with the ink chamber 61*c* at the both ends of the ink chamber 61*c* for the cyan ink along the scanning direction, and extend in the up-down direction. Here, it is not necessary for the connection passages 62 to be completely parallel to the up-down direction. In other words, the connection passages 62 work to connect the ink chambers 61 to the supply ports 49 of the head section 20, and hence, if the positions in a plan view of the ink chambers are shifted from those of the supply ports, the connection passages 62 may extend in a direction slightly inclined against the up-down direction.

In a bottom wall portion of the first ink supply member 31, two outlet ports 63*m*1 and 63*m*2 respectively communicated with the two connection passages 62*m* for the magenta ink and two outlet ports 63*c*1 and 63*c*2 respectively communicated with the two connection passages 62*c* for the cyan ink are formed. The two outlet ports 63*m*1 and 63*m*2 for the magenta ink are connected to the two supply ports 49*m*1 and 49*m*2 (see FIG. 3) for the magenta ink of the head section 20, and the two outlet ports 63*c*1 and 63*c*2 for the cyan ink are connected to the two supply ports 49*c*1 and 49*c*2 (see FIG. 3) for the cyan ink of the head section 20.

The ink supply passage 60*m* (including the ink chamber 61*m* and the two connection passages 62*m*) for the magenta ink disposed above is disposed so as to cover the ink supply passage 60*c* (including the ink chamber 61*c* and the two connection passages 62*c*) for the cyan ink from above. Therefore, the two connection passages 62*m* connected to the ink chamber 61*m* for the magenta ink disposed above are disposed on both sides of the ink chamber 61*c* for the cyan ink along the scanning direction and are adjacent to the ink chamber 61*c*. Accordingly, the ink chamber 61*c* for the cyan ink has a smaller length along the scanning direction than the ink chamber 61*m* for the magenta ink. As illustrated in FIGS. 2 and 6A, however, the ink chamber 61*c* for the cyan ink has a larger length along the conveying direction than the ink chamber 61*m* for the magenta ink and protrudes forward (downstream in the conveying direction).

Furthermore, in a top wall portion and a bottom wall portion of the horizontal portion 31*a* corresponding to wall portions forming the two ink chambers 61*m* and 61*c*, openings 32*a* and 32*b* are respectively formed, and flexible damper films 34*m* and 34*c* made of a synthetic resin film or the like are provided respectively to cover these openings. Thus, the ink chamber 61*m* for the magenta ink is covered by the damper film 34*m* from above, and the ink chamber 61*c* for the cyan ink is covered by the damper film 34*c* from below. Here, as illustrated in FIG. 5, since the gap is provided between the two ink supply members 31 and 32, a space necessary in deforming the damper film 34*c* is secured.

Next, the second ink supply member 32 will be described. As illustrated in FIGS. 5 and 6B, the inside of the second ink supply member 32 is also divided into two inner and outer spaces by partition walls 35*a* and 35*b*. The outer space corresponds to an ink supply passage 60*y* where the yellow ink passes, and the inner space corresponds to an ink supply passage 60*k* where the black ink passes.

Above the horizontal partition wall 35*a*, an ink chamber 61*y* for containing the yellow ink is formed, and below the partition wall 35*a*, an ink chamber 61*k* for containing the black ink is formed. Between right and left side walls of the second ink supply member 32 and the two partition walls 35*b* extending in the up-down direction, two connection passages 62*y* for the yellow ink are formed. The two connection passages 62*y* for the yellow ink are communicated with the ink chamber 61*y* at the both ends of the ink chamber 61*y* for the yellow ink along the scanning direction, and extend in the up-down direction. As illustrated in FIG. 6B, a connection passage 62*k* for the black ink is communicated with the ink chamber 61*k* for the black ink at the rear end portion of the ink chamber 61*k*, and extends along the conveying direction (namely, the front-back direction). Here, also the connection passages 62*y* need not be completely parallel to the up-down direction but may be inclined slightly against the up-down direction. Besides, also the connection passage 62*k* need not be completely parallel to the conveying direction but may be slightly inclined against the conveying direction.

In a bottom wall portion of the second ink supply member 32, two outlet ports 63*y*1 and 63*y*2 respectively communicated with the two connection passages 62*y* for the yellow ink and one outlet port 63*k* communicated with the connection passage 62*k* for the black ink are formed. The two outlet ports 63*y*1 and 63*y*2 for the yellow ink are connected to the two supply ports 49*y*1 and 49*y*2 for the yellow ink of the head section 20, and the one outlet port 63*k* for the black ink is connected to the one supply port 49*k* for the black ink of the head section 20.

Also in the second ink supply member 32, the ink supply passage 60*y* for the yellow ink is provided so as to cover, from above, the ink supply passage 60*k* for the black ink disposed inside. The two connection passages 62*y* communicated with the ink chamber 61*y* for the yellow ink disposed above are disposed on both sides of the ink chamber 61*k* for the black ink along the scanning direction and are adjacent to the ink chamber 61*k*. Accordingly, the ink chamber 61*k* for the black ink has a smaller length along the scanning direction than the ink chamber 61*y* for the yellow ink, but has a larger length along the conveying direction than the ink chamber 61*y* for the yellow ink, and protrudes forward (downstream in the conveying direction).

In a top wall portion of the second ink supply member 32 forming the ink chamber 61*y* for the yellow ink, an opening 36*a* is provided, and a flexible damper film 34*y* is provided to cover the opening 36*a*. Thus, the ink chamber 61*y* for the yellow ink is covered by the damper film 34*y* from above. Besides, since there is a gap between the two ink supply members 31 and 32, a space necessary in deforming the damper film 34*y* is secured. On the other hand, a portion of a bottom wall portion of the second ink supply member 32 forming the ink chamber 61*k* for the black ink and disposed on the forward side with respect to the outlet port 63*k* is raised as compared with a backward portion thereof in which the outlet port 63*k* is formed. Also in this raised portion 37, an opening 36*b* is formed, and a flexible damper film 34*k* is provided to cover the opening 36*b*. Thus, the ink chamber 61*k* for the black ink is covered by the damper film 34*k* from below. Besides, owing to the raised portion 37, the damper film 34*k* is spaced from the top surface of the head section 20, and hence, a space necessary in deforming the damper film 34*k* is secured.

As illustrated in FIG. 2, four ink introducing passages 64 (corresponding to an example of a liquid introduction passage) respectively connected to the left ends of the ink chambers 61 for the inks of the four colors are formed in the ink supply members 31 and 32. The four ink introducing passages 64 are connected respectively to the four ink cartridges 30 (see FIG. 1) attached to the holder 5 via a tube joint 23 and four tubes 22. Besides, four air discharge passages 65 respectively connected to the right ends of the four ink chambers 61 are formed in the ink supply members 31 and 32. The four air discharge passages 65 are respectively connected to the four air discharge ports 24*a* of the air discharge section 24.

The ink fed from the ink cartridge 30 via the tube 22 to the ink supply section 21 first flows into the ink chamber 61 corresponding to the ink. The ink having flown into the ink chamber 61 is supplied via the connection passage 62 to the supply port 49 of the head section 20 disposed below. Here, air is mixed with the ink supplied through the tube 22 in some cases, and if the air flows into the head section 20, it can be a factor of causing ejection failure of the nozzles 47. In the present embodiment, however, the ink chamber 61 is provided before the head section 20. When the ink flows into the connection passage 62 extending downward from the ink chamber 61, the air mixed with the ink is separated from the ink, and is left in an upper portion of the ink chamber 61. Accordingly, the ink from which the air has been separated and removed is supplied from the ink chamber 61 through the connection passage 62 to the head section 20. Here, the air once separated from the ink stays in the upper portion of the ink chamber 61, and therefore, even if an ink is subsequently supplied to the ink chamber 61, the air left in the ink chamber 61 does not flow to the head section 20.

In accordance with the consumption of the ink in the head section 20, however, the air separated from the ink is collected in the ink chamber 61, and the amount of air staying in the upper portion of the ink chamber 61 increases. If the ink chamber 61 is filled with the air, a part of the air unavoidably flows through the connection passage 62 to the head section 20. Therefore, the above-described air discharge purge is performed at predetermined time intervals, so that the air staying in the ink chamber 61 can be discharged via the air discharge chamber 65 through the air discharge port 24*a* of the air discharge section 24. Here, as illustrated with an arrow in FIG. 2, each ink supply passage 60 of the ink supply section 21 is one passage extending from the ink introducing passage 64 via the ink chamber 61 to the air discharge passage 65 having no branch in the middle, and hence, the air flows unicursally. Accordingly, the property of each ink supply passage 60 to discharge the air is increased, and the air is difficult to stay in the middle of the ink supply passage 60.

The arrangement of the ink chambers 61 and the connection passages 62 for the inks of the four colors in the ink supply section 21 described above is summarized as follows. As illustrated in FIGS. 5, 6A and 6B, the four ink chambers 61 respectively containing the inks of the four colors are stacked on one another in the up-down direction (corresponding to an example of a direction perpendicular to the surface) in the ascending order of black, yellow, cyan and magenta. In other words, the four ink chambers 61 connected to the supply ports 49 are disposed to overlap one another in the up-down direction above the seven supply ports 49 arranged in the scanning direction along the horizontal plane. Owing to this structure, as compared with a structure in which the four ink chambers 61 are arranged along the scanning direction, the area of each ink chamber 61 can be secured large while controlling small the plan view size of the ink supply section 21. Accordingly, a larger amount of air can be allowed to stay in each ink chamber 61.

Besides, among the four ink chambers 61, the two connection passages 62 communicated with one ink chamber 61 disposed above are disposed on both sides of the other ink chamber 61 disposed below along the scanning direction and are adjacent to the other ink chamber 61. For example, the two connection passages 62*y* communicated with the ink chamber 61*y* for the yellow ink are disposed on both sides of the ink chamber 61*k* for the black ink along the scanning direction and are adjacent to the ink chamber 61*k*. Here, in this exemplified case, the ink chamber 61*k* for the black ink corresponds to an example of a first liquid chamber, and the ink chamber 61*y* for the yellow ink corresponds to an example of a second liquid chamber. In this manner, the passage structure in which one ink supply passage 60 disposed below is provided inside the other ink supply passage 60 disposed above can be realized, and thus, the ink chambers 61 for the inks of the four colors and the connection passages 62 for the ink of the four colors can be compactly constructed.

In the above-described structure, however, the ink chamber 61 disposed below is disposed along the scanning direction between the two connection passages 62 communicated with the ink chamber 61 disposed above, and therefore, there is a limit in increasing the length along the scanning direction of the ink chamber 61 disposed below in order to increase its area. Therefore, the ink chamber 61 disposed below has a larger length along the conveying direction than the ink chamber 61 disposed above. In other words, among the four ink chambers 61, the length along the conveying direction is larger as the ink chamber is disposed in a lower position. Owing to this structure, the area of an ink chamber 61 disposed below can be made equivalent to the area of another ink chamber 61 disposed above.

Moreover, in the present embodiment, the damper films 34 are provided as a part of the wall portions forming the respective ink chambers 61 in the ink supply members 31 and 32, and thus, each ink chamber 61 also works as a damper chamber for attenuating ink pressure variation. In order to increase the effect of the damper chamber to attenuate the ink pressure variation, the area of the damper chamber is preferably as large as possible. In this respect, the structure in which the four ink chambers are disposed to overlap one another in the up-down direction is employed as described above, and therefore, the area of each ink chamber also working as the damper chamber can be secured large. Besides, since the ink chamber 61 for separating air from the ink also works as the damper chamber, as compared with a structure where a damper chamber is separately provided, the ink supply section 21 can be made more compact.

Next, modifications obtained by variously modifying the present embodiment will be described. In the following description, like reference signs are used to refer to like elements used in the embodiment described above, so as to avoid redundant description.

Figure 7:
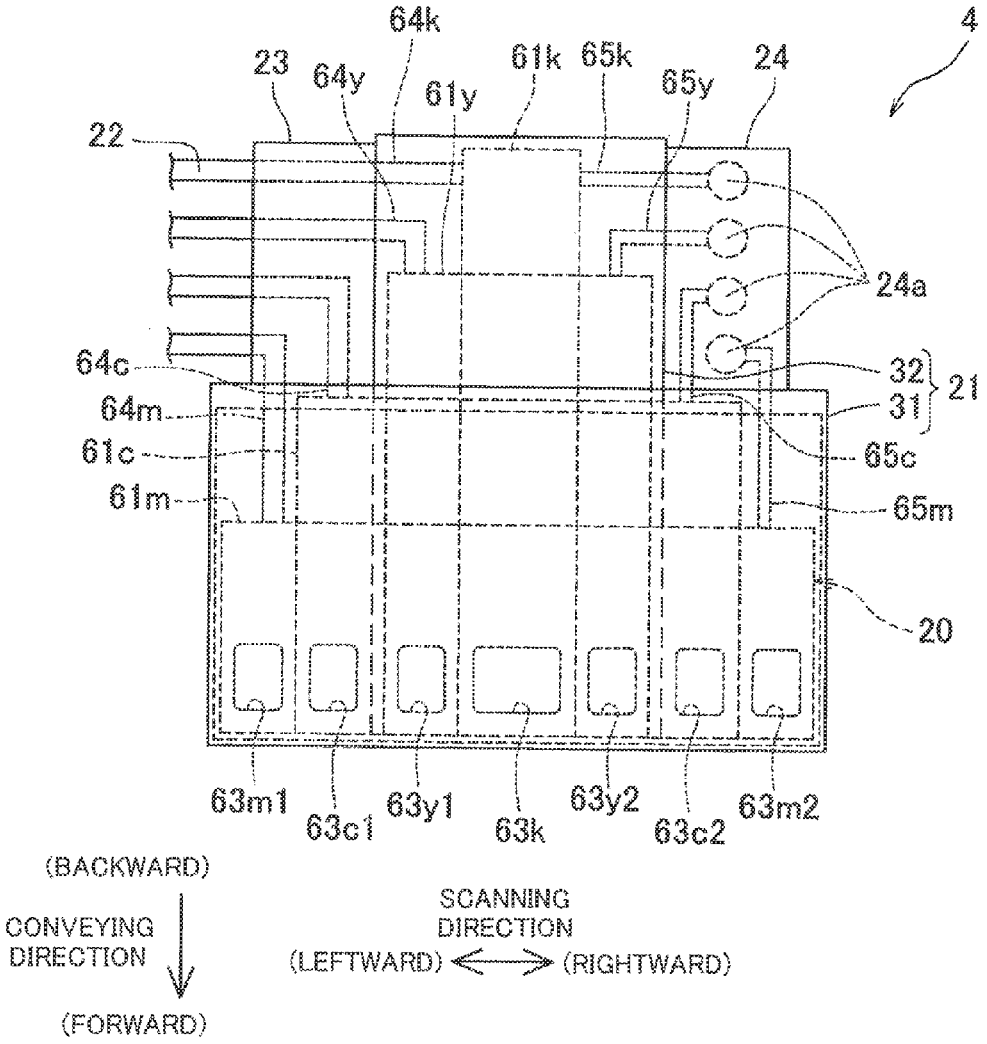
FIG. 7 is a top view of an ink ejection device according to a modification.

1] In the above-described embodiment, the four ink chambers 61 disposed to overlap one another in the up-down direction have different lengths along the conveying direction, so that an ink chamber disposed in a lower position can protrude more forward (downstream in the conveying direction). On the contrary, an ink chamber 61 disposed in a lower position may protrude more backward (upstream in the conveying direction) than another ink chamber 61 disposed in an upper position as illustrated in FIG. 7.

Figure 8:
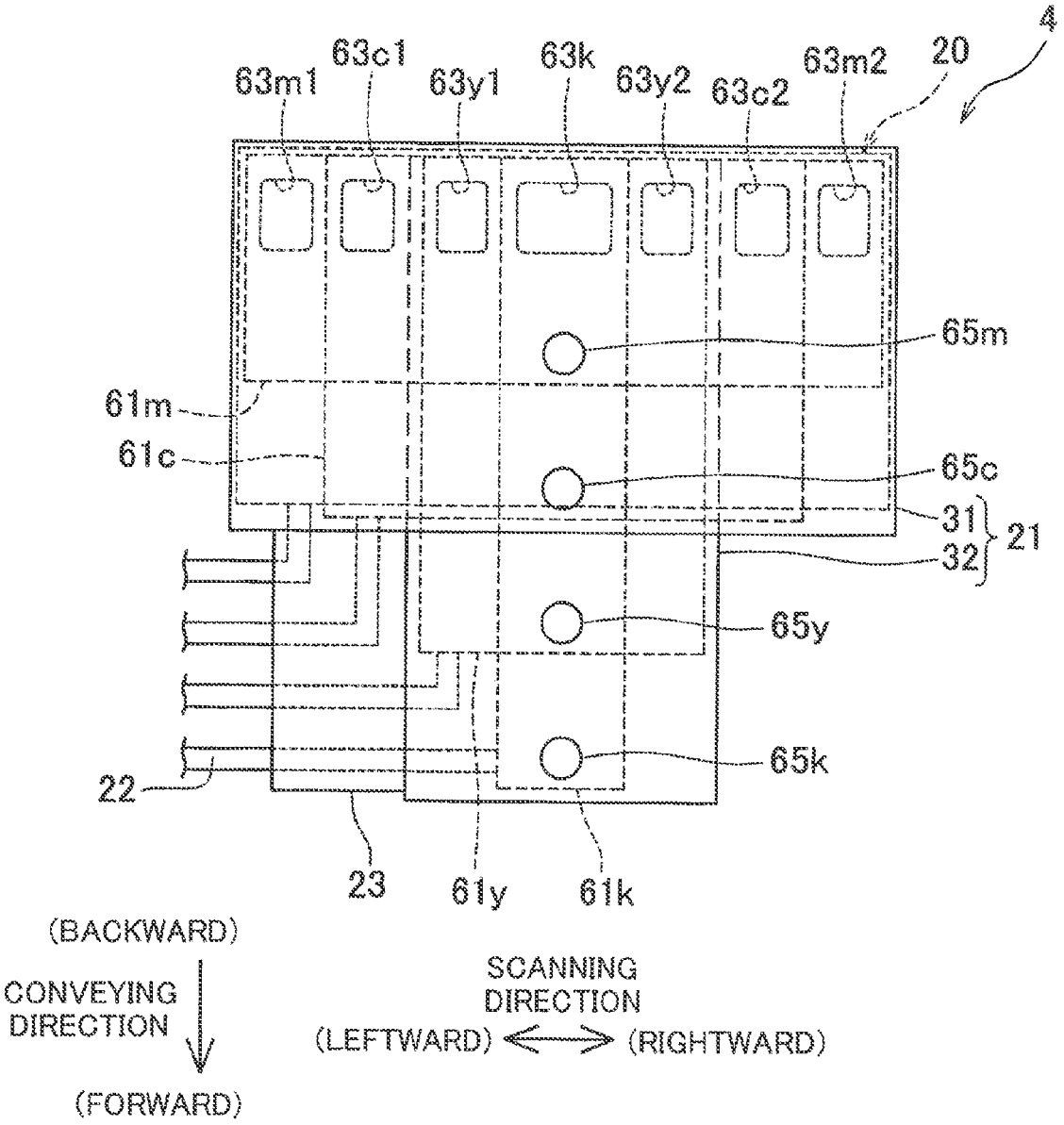
FIG. 8 is a top view of an ink ejection device according to another modification.

2] Each air discharge passage 65 connected to each ink chamber 61 can be appropriately modified as follows. For example, as illustrated in FIG. 8, the air discharge passage 65 or an air discharge port may be provided in a top wall portion of the ink supply member 31 or 32 forming the ceiling of each ink chamber 61. When the air discharge passage 65 or an air discharge port is provided in the ceiling of the ink chamber 61, the air discharge effect can be increased. Besides, the four ink chambers 61 are overlapped one another in the up-down direction, and an ink chamber 61 disposed in a lower position extends longer in the conveying direction than another ink chamber 61 disposed in an upper position. Therefore, a front portion of an ink chamber 61 disposed below does not overlap an ink chamber 61 disposed above. Therefore, the air discharge passage 65 or an air discharge port can be provided in a portion of the ceiling of the ink chamber 61 disposed below not overlapping the ink chamber 61 disposed above.

Figure 9:
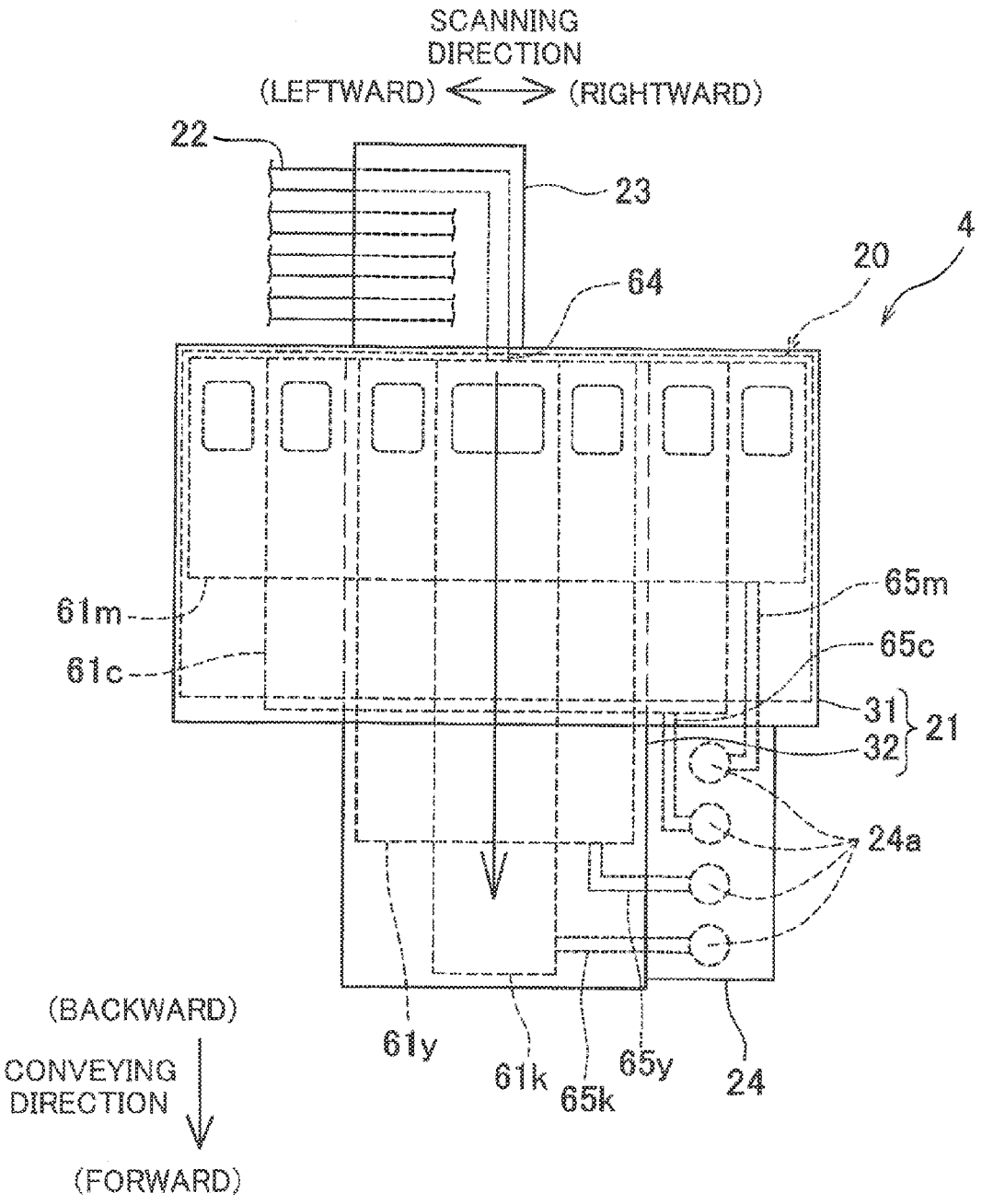
FIG. 9 is a top view of an ink ejection device according to still another modification.

3] The ink introducing passage 64 (corresponding to an example of the liquid introduction passage) and the air discharge passage 65 (corresponding to an example of the air discharge section) of each ink supply passage 60 may be provided on the opposite sides in the conveying direction. In a modification illustrated in FIG. 9, the four ink introducing passages 64 are connected to the upstream ends (rear ends) of the ink supply members 31 and 32 of the ink supply section 21 along the conveying direction. It is noted that FIG. 9 is a top view and hence the four ink introducing passages 64 overlap one another and look as if they were one passage. The four ink introducing passages 64 are connected to the tube joint 23 attached to the rear end surfaces of the ink supply members 31 and 32. Besides, the four ink introducing passages 64 are respectively connected to rear end portions of the four ink chambers 61 disposed to overlap one another in the up-down direction. On the other hand, in front portions of the ink supply members 31 and 32, the four air discharge passages 65 respectively connected to the front end portions of the four ink chambers 61 are formed.

As compared with the above-described embodiment illustrated in FIG. 2 in which the ink introducing passages 64 and the air discharge passages 65 are disposed on the same side in the conveying direction, the bend of each ink supply passage 60 extending from the ink introducing passage 64 to the air discharge passage 65 can be reduced in this modification as illustrated with an arrow in FIG. 9. Accordingly, the air mixed in the ink having been introduced through the ink introducing passage 64 is difficult to stay in the middle of the passage and is easily discharged through the air discharge passage 65.

4] The four ink chambers 61 having different lengths along the scanning direction may have the same length along the conveying direction. In this case, the area is different among the four ink chambers 61, and an ink chamber disposed in a lower position has a smaller area. Accordingly, an ink largely consumed is supplied to the ink chamber 61 disposed in the uppermost position and having the largest area, and on the contrary, an ink consumed small is supplied to the ink chamber 61 disposed in the lowermost position and having the smallest area. For example, the black ink, which is liable to be consumed most largely because it is used in both text printing and color printing, is supplied to the ink chamber 61 disposed in the uppermost position. Besides, if the number of nozzles 47 for ejecting a specific ink (for example, the black ink) is larger than the numbers of the nozzles 47 for ejecting another ink in the head section 20, the ink ejected from the nozzles 47 in a larger number is liable to be consumed more largely, and hence, the specific ink is supplied to the ink chamber 61 disposed in the uppermost position.

Alternatively, the possibility of the air mixing in the ink may be different among the inks of the four colors because, for example, the four tubes 22 for respectively supplying the inks of the four colors are different in the thickness or material. In such a case, an ink in which the air is more easily mixed is supplied to the ink chamber 61 disposed in the uppermost position, and an ink in which the air is more difficult to be mixed is supplied to the ink chamber 61 disposed in the lowermost position.

5] In the embodiment described above, the supply ports 49*y*, 49*c* and 49*m* for the inks of the three colors of yellow, cyan and magenta are arranged on the both left and right sides of the supply port 49*k* for the black ink in the head section 20. On the contrary, the head section 20 may have a structure in which merely one supply port 49 is provided correspondingly to each type of inks as illustrated in FIG. 10.

Figure 10:
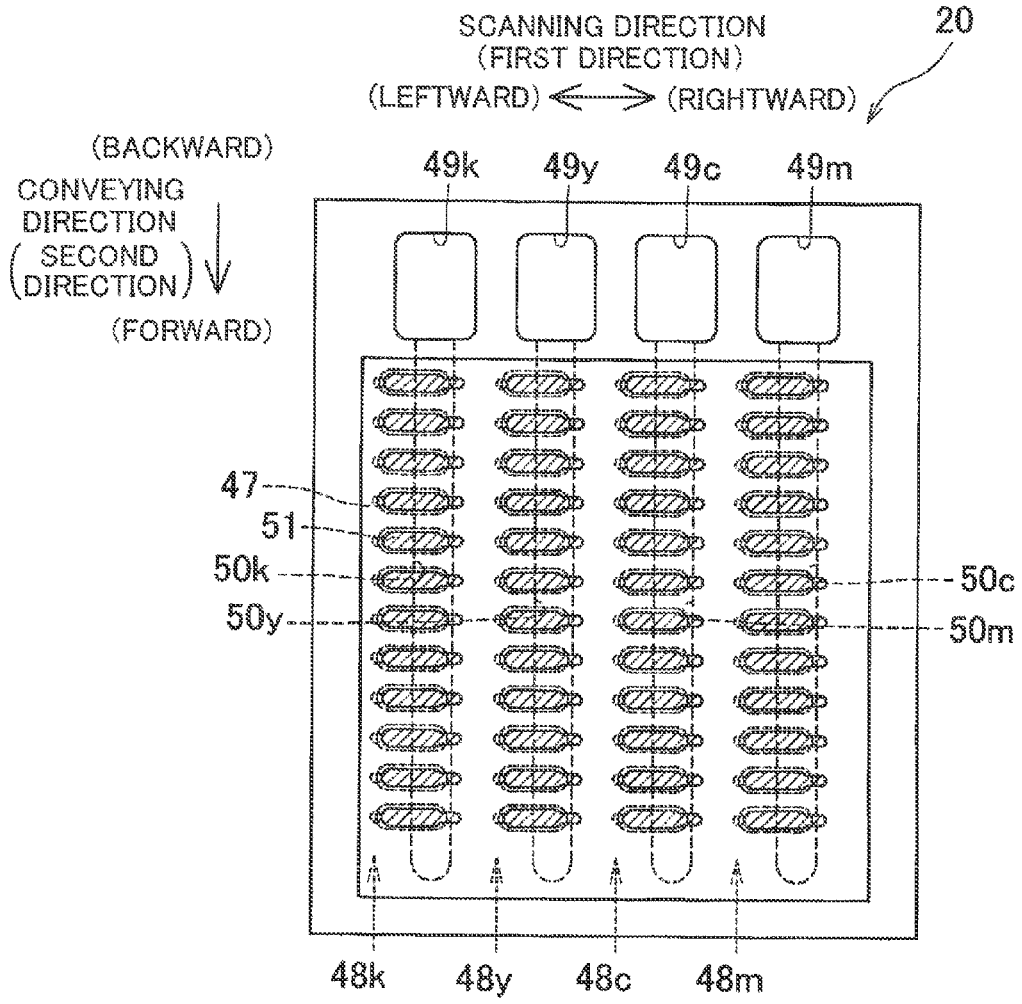
FIG. 10 is a top view of a head section according to a modification.
Figure 11:
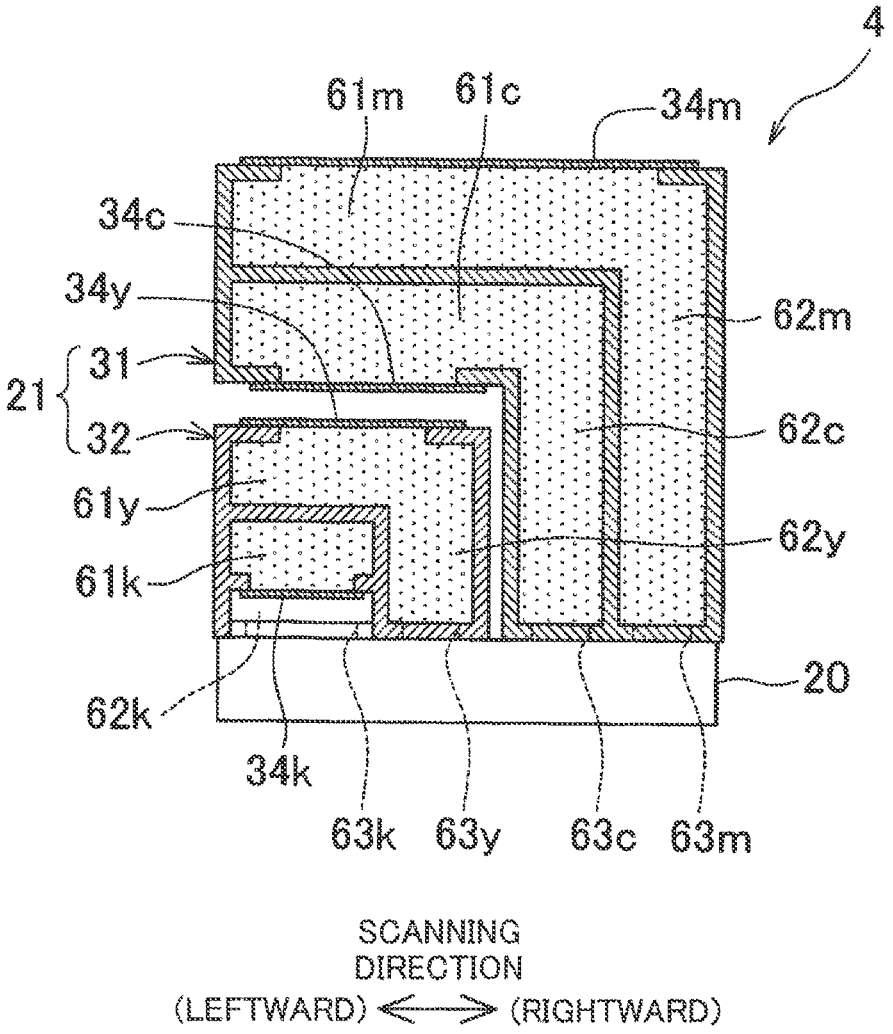
FIG. 11 is a cross-sectional view of an ink ejection device comprising the head section of FIG. 10.

FIG. 11 is a cross-sectional view of an ink ejection device 4 including the head section 20 of FIG. 10. As illustrated in FIG. 11, four ink chambers 61 for respectively containing the inks of the four colors are provided to overlap one another in the up-down direction. Besides, the four ink chambers 61 and the four supply ports 49 of the head section 20 are respectively mutually connected via four connection passages 62.

Also in the structure of FIG. 11, among the four ink chambers 61, an ink chamber 61 disposed in a lower position is provided adjacently along the scanning direction to the connection passage 62 communicated with an ink chamber 61 disposed in an upper position. Therefore, the ink chamber 61 disposed in the lower position has a smaller length along the scanning direction than the ink chamber 61 disposed in the upper position. Accordingly, also in FIG. 11, the ink chamber 61 disposed in the lower position may have a larger length along the conveying direction than the ink chamber 61 disposed in the upper position.

6] In the embodiment described above, the flexible damper film 34 is provided as a part of the wall portion forming each of the ink chambers 61 in the ink supply members 31 and 32, and the ink chamber 61 also works as the damper chamber. However, this configuration is not indispensable. A damper chamber having the damper film 34 may be provided separately from the ink chamber 61. Alternatively, if the pressure variation caused in each of the ink supply passages 60 of the ink supply section 21 is comparatively small, there is no need to provide the damper film 34.

7] In the embodiment described above, the ink supply section 21 includes the two ink supply members 31 and 32, and each of the two ink supply members 31 and 32 has the two types of ink supply passages 60. On the contrary, the ink supply passages 60 for the inks of all the four colors may be provided together in one ink supply member. Alternatively, the ink supply passages 60 for the inks of the four colors may be formed respectively in separate ink supply members.

8] In the embodiment described above, the ink supply section 21 in which a plurality of ink chambers 61 are disposed to overlap one another in the up-down direction is disposed above the head section 20 so as to eject the inks in the up-down direction. However, this configuration is not indispensable. An ink supply section in which a plurality of ink chambers 61 are arranged in the horizontal direction may be provided on one side of the head section along the horizontal direction (i.e., the scanning direction) so as to eject the inks in the horizontal direction.

9] In the embodiment described above, the four ink chambers 61 overlap each other in the up-down direction. However, this configuration is not indispensable. For example, the ink chambers for the yellow ink, cyan ink and magenta ink may be aligned in the conveying direction so as not to overlap each other in the up-down direction, and these ink chambers for the inks of three colors may overlap the ink chamber for the black ink in the up-down direction. Alternatively, the ink chamber for the black ink and the ink chamber for the yellow ink only may overlap each other in the up-down direction, and the ink chambers for the cyan ink and magenta ink may be disposed so as not to overlap the ink chamber for the black ink in the up-down direction.

In the embodiment described above, air staying in the ink chamber 61 is discharged through the air discharge passage 65 out of the air discharge port 24*a* of the air discharge section 24. However, the air discharge section 24 may not be provided in the ink supply section 21. In such a configuration, with the plural nozzles 47 of the head section 20 covered by the nozzle cap 25, the internal pressure of the nozzle cap 25 is reduced by the suction pump 10, thereby the air staying in the ink chamber 61 is discharged out of the plural nozzles 47 through the head section 20.

As described above, the above-mentioned embodiment and the modifications thereof are applied to an ink ejection device of an ink jet printer ejecting ink onto recording paper so as to print an image or the like. In addition, the embodiment and the modifications may be applied also to a liquid ejection device used in various applications other than printing of an image or the like. For example, the embodiment and the modifications may be applied also to a liquid ejection device ejecting an electrically conductive liquid onto a substrate so as to form an electrically conductive pattern on a surface of the substrate.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

What is claimed is:

1. A liquid ejection device, comprising:

a liquid ejection head including a plurality of nozzles on a surface thereof and being configured to eject a plurality of types of liquids, each of the nozzles being configured to eject one type of liquid among the plurality of types of liquids; and a liquid supply tank configured to supply the plurality of types of liquids to the liquid ejection head, wherein the liquid ejection head includes a plurality of supply ports which are arranged along a first direction and to each of which one type of liquid among the plurality of types of liquids is supplied, the plurality of supply ports including a first supply port to which a first liquid among the plurality of types of liquids is supplied and two second supply ports to which a second liquid among the plurality of types of liquids is supplied, and the two second supply ports are disposed on both sides of the first supply port along the first direction, and the liquid supply tank includes:

a plurality of liquid chambers, each of which being configured to contain each type of liquid; and a plurality of connection passages connecting the plurality of supply ports of the liquid ejection head to the plurality of liquid chambers respectively configured to contain the plurality of types of liquids to be supplied to the plurality of supply ports, and the plurality of liquid chambers include a first liquid chamber configured to contain the first liquid and a second liquid chamber configured to contain the second liquid, and the connection passages include a first connection passage connecting the first supply port of the liquid ejection head to the first liquid chamber, and two second connection passages connecting the two second supply ports of the liquid ejection head to the second liquid chamber, and the two second connection passages are disposed on both sides of the first liquid chamber along the first direction, the second liquid chamber overlaps the first liquid chamber in a direction perpendicular to the surface and crossing the first direction, and is disposed farther away from the liquid ejection head than the first liquid chamber in the direction perpendicular to the surface.

2. The liquid ejection device according to claim 1, wherein, as the plurality of supply ports other than the first supply port and the two second supply ports, two supply ports are disposed for each of the plurality of types of liquids other than the first liquid and the second liquid, and said two supply ports are disposed on both sides of the first supply port along the first direction, respectively, and the plurality of liquid chambers overlap each other in the direction perpendicular to the surface, and the plurality of liquid chambers other than the first liquid chamber are disposed farther away from the liquid ejection head in order of the supply ports, to which the liquid chambers are connected, being farther away from the first supply port in the first direction.

3. The liquid ejection device according to claim 1, wherein, regarding two liquid chambers among the plurality of liquid chambers, the connection passage connected to one liquid chamber disposed farther away from the liquid ejection head than the other liquid chamber along the direction perpendicular to the surface is adjacent along the first direction to the other liquid chamber, the other liquid chamber has a smaller length along the first direction than that of the one liquid chamber, and the other liquid chamber has a larger length along a second direction crossing the first direction and the direction perpendicular to the surface than that of the one liquid chamber.

4. The liquid ejection device according to claim 1, wherein the first liquid is a black ink, and the second liquid is a color ink, and the black ink is supplied to the first supply port, and the color ink is supplied to the two second supply ports.

5. The liquid ejection device according to claim 1, wherein the first liquid chamber has a larger length along a second direction crossing the first direction and the direction perpendicular to the surface than that of the second liquid chamber.

6. The liquid ejection device according to claim 5, wherein the liquid supply tank includes a plurality of air discharge passages respectively connected to the plurality of liquid chambers, and the air discharge passages are provided in a portion of the first liquid chamber disposed on one side along the direction perpendicular to the surface and not overlapping the second liquid chamber.

7. The liquid ejection device according to claim 1, wherein the liquid supply tank includes a plurality of liquid introduction passages respectively connecting the plurality of liquid chambers to a plurality of liquid storage tanks respectively configured to store the plurality of types of liquids, and a plurality of air discharge passages respectively connected to the plurality of liquid chambers, the plurality of liquid introduction passages are disposed on one side of the liquid supply tank along a second direction crossing the first direction and the direction perpendicular to the surface, and the plurality of air discharge passages are disposed on the other side of the liquid supply tank along the second direction.

8. The liquid ejection device according to claim 1, wherein a flexible damper film is provided as a part of a wall portion forming each of the plurality of liquid chambers.

9. The liquid ejection device according to claim 1, wherein a length of the plurality of liquid chambers along the first direction is smaller in order of arranging the plurality of liquid chambers along the direction perpendicular to the surface, and a length of the plurality of liquid chambers along a second direction crossing the first direction and the direction perpendicular to the surface is larger in order of arranging the plurality of liquid chambers along the direction perpendicular to the surface.

10. The liquid ejection device according to claim 1, wherein the liquid supply tank includes a plurality of air discharge passages respectively connected to the plurality of liquid chambers, and the liquid ejection device further comprises an air discharge section connected to each of the plurality of air discharge passages and configured to discharge air out of the plurality of liquid chambers.

* * * * *